US006230528B1

(12) United States Patent
Don et al.

(10) Patent No.: US 6,230,528 B1
(45) Date of Patent: May 15, 2001

(54) ADJUSTABLE DEVICE FOR AN AUXILIARY LOCK

(75) Inventors: Lan-Kun Don; Ching-Chuan Kuo, both of Chia-Yi Hsien (TW)

(73) Assignee: Tong Lung Metal Industry Co., Chia-Yi (TW)

( * ) Notice: Subject to any disclaimer, the term of this patent is extended or adjusted under 35 U.S.C. 154(b) by 0 days.

(21) Appl. No.: 09/387,763

(22) Filed: Sep. 1, 1999

(30) Foreign Application Priority Data

Sep. 4, 1998 (TW) ..... 87214702

(51) Int. Cl.[7] ..... E05B 9/08
(52) U.S. Cl. ..... 70/370; 70/224; 70/451
(58) Field of Search ..... 70/221–224, 367–374, 70/451, 449

(56) References Cited

U.S. PATENT DOCUMENTS 3,514,983 * 6/1970 Krook et al. ..... 70/370
3,930,390 * 1/1976 Keller ..... 70/370 X
3,934,437 * 1/1976 Crepinsek ..... 70/370
4,573,334 * 3/1986 Crepinsek ..... 70/370 X
5,335,525 * 8/1994 Solovieff ..... 70/370
5,540,070 * 7/1996 Adelmeyer ..... 70/370
5,666,833 * 9/1997 Gao et al. ..... 70/224
5,881,590 * 3/1999 Small ..... 70/451
5,906,125 * 5/1999 Shen ..... 70/370
5,983,683 * 11/1999 Shen ..... 70/224
6,058,746 * 5/2000 Mirshafiee et al. ..... 70/370 X

* cited by examiner

*Primary Examiner*—Suzanne Dino Barrett
(74) *Attorney, Agent, or Firm*—Rosenberg, Klein & Lee

(57) ABSTRACT

An adjustable device for an auxiliary lock to be mounted on a door for security purpose, comprises an adaptor and a guard collar, wherein the adaptor comprises a first section with a smaller diameter, a second section with a larger diameter, a third section connecting the first and the second sections, a fourth section connecting to the third section; the guard collar has a first recess and a second recess to receive the fourth section, respectively, whereas if the fourth section matches into the first recess, the first section of the adaptor is available to the door with a smaller lock hole, and whereas the fourth section matches into the second recess, the second section of the adaptor is available to the door with a larger lock hole.

5 Claims, 5 Drawing Sheets

ADJUSTABLE DEVICE FOR AN AUXILIARY LOCK

FIELD OF THE INVENTION

This invention relates to an auxiliary lock and more particulars to a lock with an adjustable size to fit into door lock hole of different sizes.

BACKGROUND OF THE INVENTION

All regular doors have a lock hole predrilled thereon to mount with a lock therein for securing purpose, those lock holes are generally in two different sizes, one in 1½ inches and the other in 2⅛ inches. Though the lock also has tow different sizes, in many times, user found their lock is different in size to the door lock hole and have to run back and forth to get the right one which is very inconvenient.

In solving this problem, two patented arts, U.S. Pat. No. 5,335,525 and 5,540,070 are introduced into the market, U.S. Pat. No. 5,335,525 discloses a cylinder 22 of an adapter 16 is inserted into a groove 44 of a guard collar 18, and cylinder 24 into an opening 36 of the guard collar 18, whereas U.S. Pat. No. 5,540,070 connects an adapter 16 with a guard collar 12 and both are to solve the problem, however, these two are not the only way to solve the problem.

SUMMARY OF THE INVENTION

It is the primary object of the present invention to provide an adjustable device for an auxiliary lock which will fit to different sizes of door lock hole;

It is another object of the present invention to provide the adjustable device for an auxiliary lock which is easy in installation.

DETAILED DESCRIPTION OF THE PREFERRED EMBODIMENTS

Figure 1:
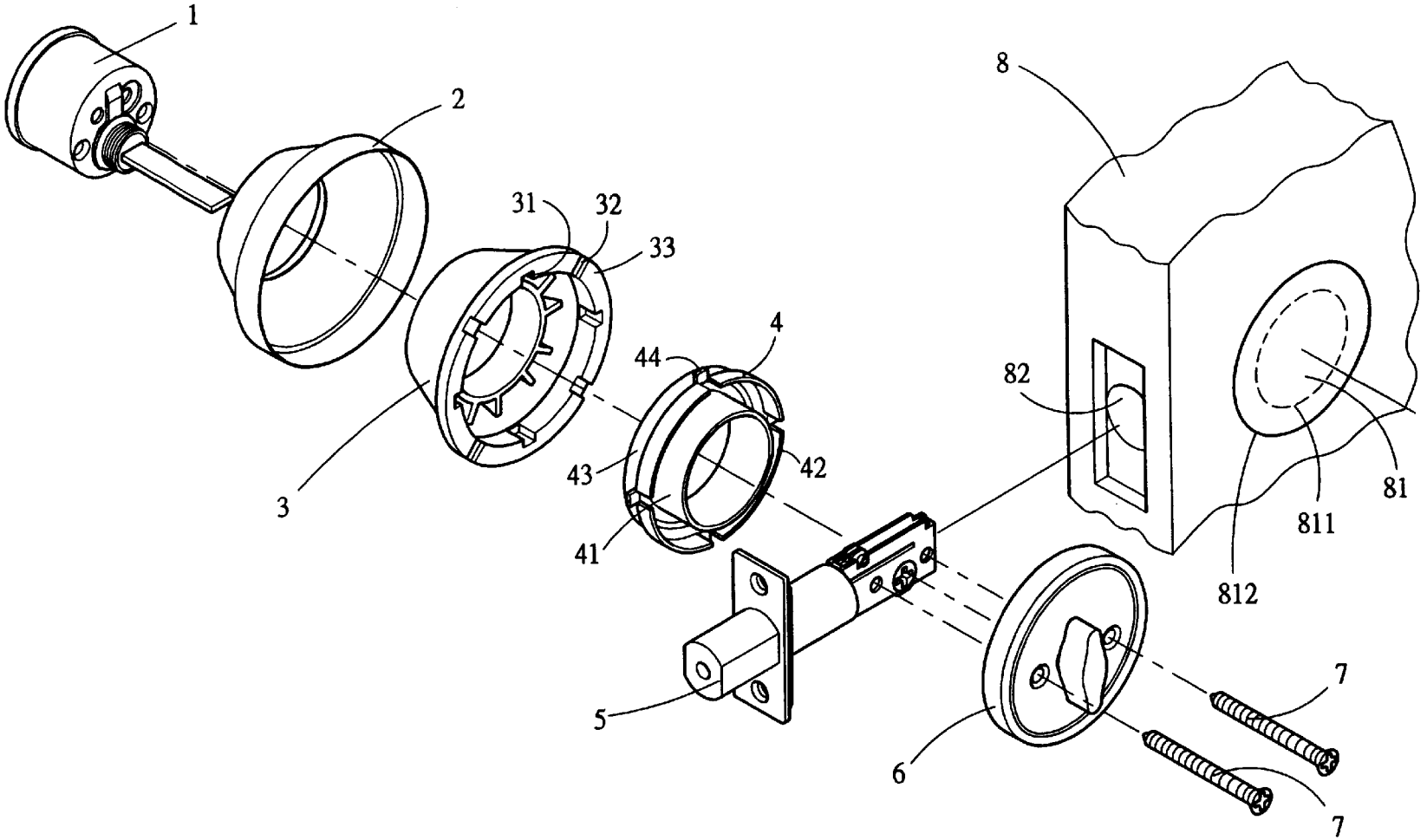
FIG. 1 is an exploded view of the present invention.

The adjustable device for a door lock of the present invention, as shown in FIG. 1, comprises a guard collar 3 and an adaptor 4.

The guard collar 3 comprises two recessed 31 and 32, a first recess 31 located at first angle and a second recess 32 located at the second angle, both recesses 31 and 32 are formed from flange 33 inwardly, wherein the first recess 31 having a depth larger than that of the second recess 32.

The adaptor 4 comprises a first section 41 having a smaller diameter to fit into a door 8 with a smaller lock hole 811 and a second section 42 having a larger diameter to fit into a door 8 with a larger lock hole 812, a third section 43 connecting the first and the second sections 41 and 42, a fourth section 44 connecting to the third section 43 and extending along with the radial direction outwardly.

Figure 2:
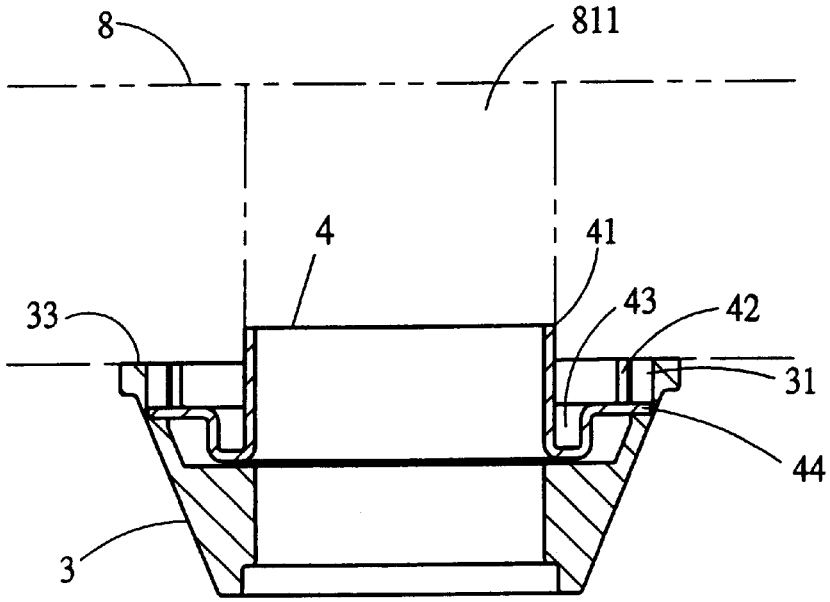
FIG. 2 is a side cross section view of the lock being installed into a door with a smaller lock hole.

The fourth section 44 of the adaptor 4, as shown in FIG. 2, matches with the first recess 31, the first section 41 will protrude from the flange 33 and matches with the smaller lock hole 811 on the door 8.

Figure 3:
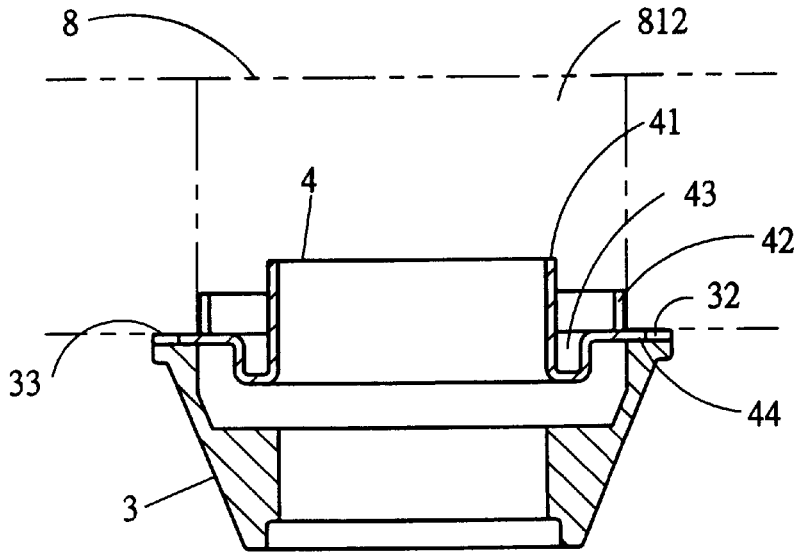
FIG. 3 is a view similar to FIG. 2, with the lock installed into a larger lock hole.

The FIG. 3 shows that when the fourth section 44 matches with the second recess 32, the second section 42 protruding outward from the flange 33 which then matches with the larger lock hole 812 of the door 8.

As shown in FIG. 1, the fourth section 44 of the adaptor 4 connected to the third section 43 and extended along with the radial direction outwardly. In alteration way, the fourth section 44 may also extend along with the radial direction from the second section 42 outwardly.

When the present invention is used with an auxiliary lock device, as shown in FIG. 1, the present invention is installed on a door 8 with all the accessories which includes the guard collar 3, the adaptor 4, a lock core 1, a cover 2, an inner cover 6, a deadbolt 5 and two bolts 7, wherein the installation of the lock onto a door 8 is a ordinary skill, and therefore will not be described hereinafter.

Figure 4:
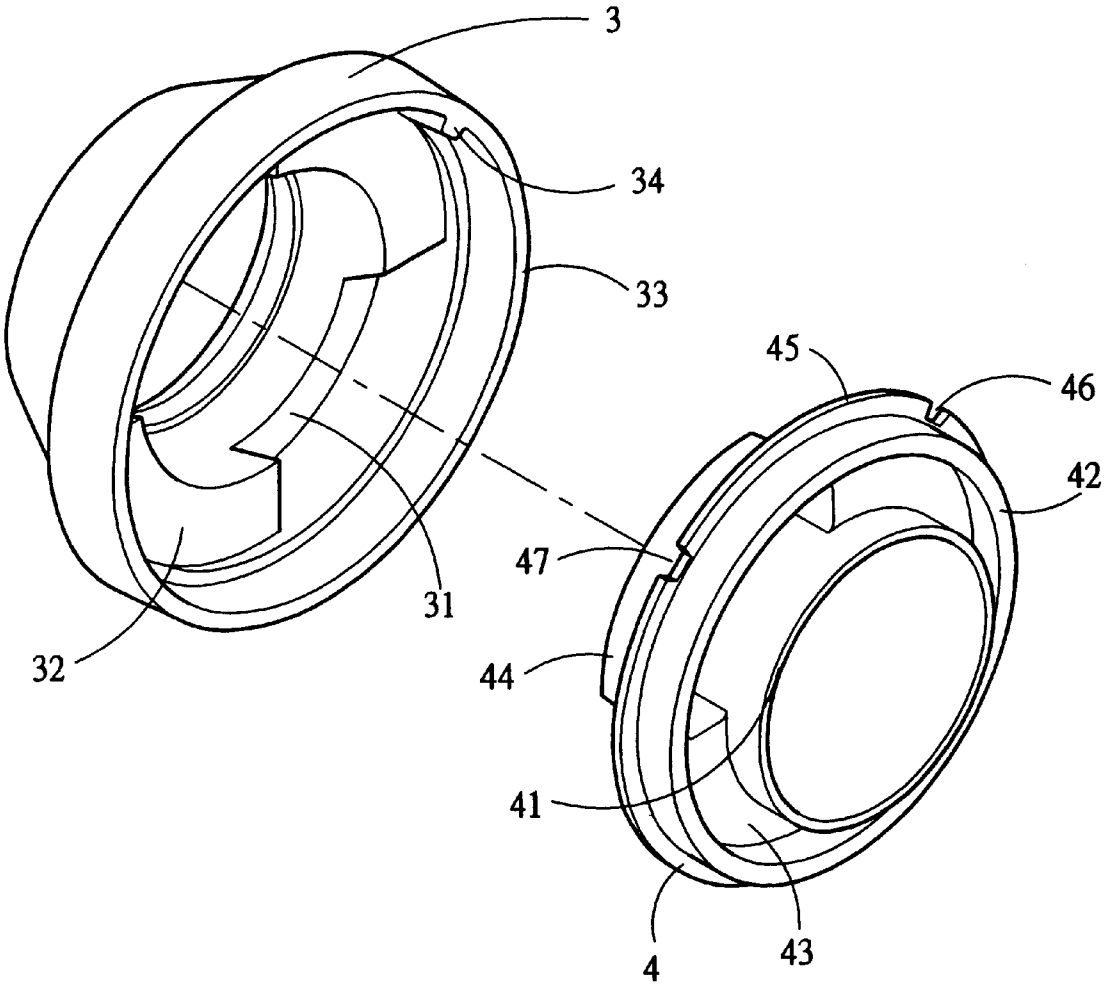
FIG. 4 is a second embodiment of a guard collar and an adaptor of the present invention.

The guard collar 3 and the adaptor 4 may be modified, as shown in FIG. 4 to form another embodiment. The guard collar 3 comprises a first recess 31 and a second recess 32 formed from flange 33 inwardly, wherein the first recess 31 has a larger depth than the second recess 32, and a tongue 34.

The adaptor 4 comprises a first section 41 having a smaller diameter to fit into a door with a smaller lock hole 811 and a second section 42 having a larger diameter to fit into a door with a larger lock hole 812, a third section 43 connecting the first and the second sections 41 and 42, a fourth section 44 connecting to the third section 43 and extending along with the axial direction forward, The adaptor 4 further has a ring 45 extending from the second section 42, the ring 45 comprises a first notch 46 and a second notch 47.

Figure 5:
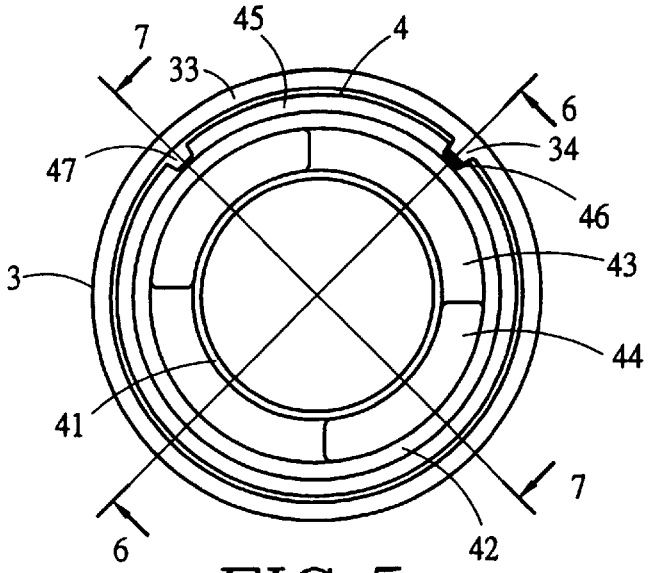
FIG. 5 is a top sectional view showing the second embodiment being mounted to a door lock hole.
Figure 6:
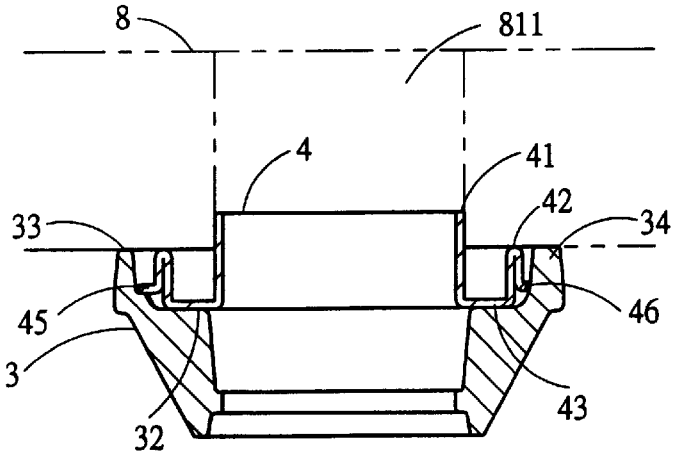
FIG. 6 is a side-sectional view taking along line 6—6 of FIG. 5.
Figure 7:
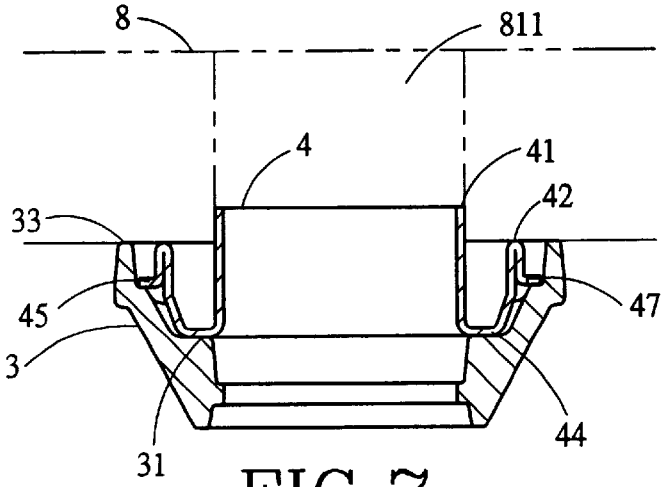
FIG. 7 is another side sectional view taking line 7—7 of FIG. 5.

FIGS. 5, 6 and 7 are shown, upon the fourth section 44 of the adaptor 4 meshes with the first recess 31 of the guard collar 3, the first section 41 of the adaptor 4 protruding from the flange 33 of the guard collar 3 outwardly and fitted into the smaller lock hole 811 of the door 8, and the tongue 34 of the guard collar 3, at this moment, meshes with the first notch 46 to secure the guard collar 3 and the adaptor 4 in a fixed place.

Figure 8:
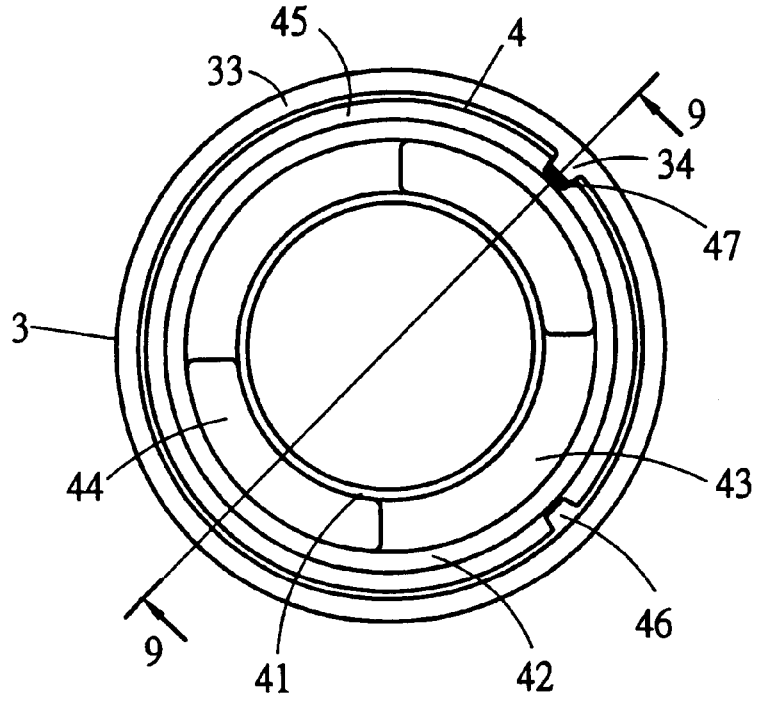
FIG. 8 is a top sectional view showing the lock device being mounted on the door with a larger lock hole.
Figure 9:
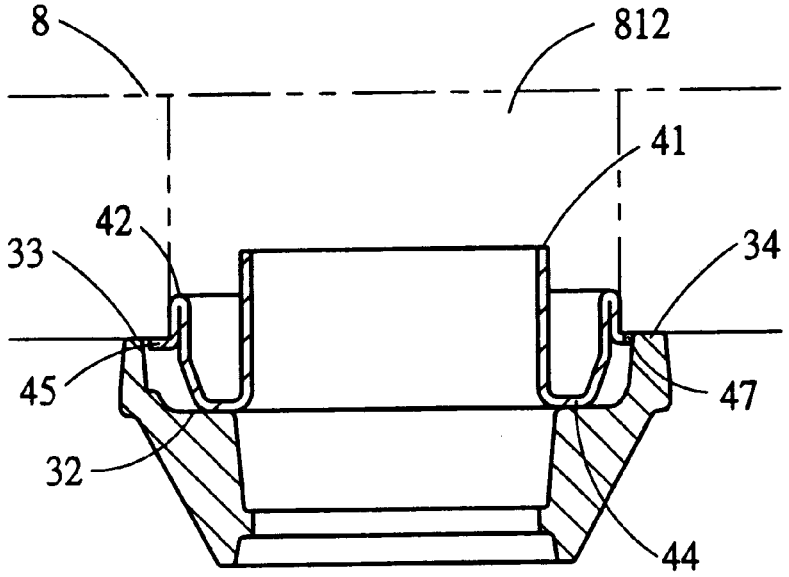
FIG. 9 is a side section view taking along line 9—9 of FIG. 8.

FIGS. 8 and 9 are shown, upon the fourth section 44 of the adaptor 4 meshes with the second recess 32 of the guard collar 3, the second section 42 of the adaptor 4 protruding form the flange 33 of the guard collar 3 outwardly and fitted into the larger lock hole 812 of the door 8, and the tongue 34 of the guard collar 3, at this moment, meshes with the second notch 47 to secure the guard collar 3 and the adaptor 4 in a fixed place.

What is claimed is:

1. An adjustable device for an auxiliary lock comprising an adaptor and a guard collar, wherein said adaptor includes a first section, a second section, a third section and a fourth section, and said guard collar comprising a first recess and a second recess;

said first section of said adaptor having a size matching a smaller sized lock hole on a door for insertion therein;

said second section having a size matching a larger lock hole on a door for insertion;

said third section being connected to said first section and said second section;

said fourth section being connected to said third section, said fourth section of said adaptor extending in a radially outward direction form said third section;

said first recess of said guard collar being formed on a first angle location, and, said second recess of said guard collar being formed on a second angle location, and wherein said fourth section of said adaptor meshes with said first recess of said guard collar, said first section of the adaptor being appropriate for a door with a smaller lock hole, and wherein said fourth section of said adaptor meshes with said second recess of said guard collar, said second section of the adaptor being appropriate for a door with a larger lock hole.

2. An adjustable device for an auxiliary lock comprising an adaptor and a guard collar, wherein said adaptor includes a first section, a second section, a third section and a fourth section, and said guard collar comprising a first recess and a second recess, said first recess of said guard collar having a depth larger than said second recess;

said first section of said adaptor having a size matching a smaller sized lock hole in a door for insertion therein;

said second section having a size matching a larger lock hole on a door for insertion;

said third section being connected to said first section and said second section;

said fourth section being connected to said third section;

said first recess of said guard collar being formed on a first angle location, and, said second recess of said guard collar being formed on a second angle location, and wherein said fourth section of said adaptor meshes with said first recess of said guard collar, said first section of the adaptor being appropriate for a door with a smaller lock hole, and wherein said fourth section of said adaptor meshes with said second recess of said guard collar, said second section of the adaptor being appropriate for a door with a larger lock hole.

3. An adjustable device for an auxiliary lock comprising an adaptor and a guard collar, wherein said adaptor comprising a first section, a second section, a third section and a fourth section, and said guard collar comprising a first recess and a second recess, said first section of said adaptor having a size matching a smaller sized lock hole in a door for insertion therein;

said second section having a size matching a larger lock hole on a door also for insertion;

said third section being connected to said first and said second sections;

said fourth section being connected to said connected to said second section;

said first recess of said guard collar being formed on a first angle location, and said second recess being formed on a second angle location, and wherein, upon said fourth section of said adaptor meshes with said first recess of said guard collar, said first section of the adaptor is appropriate for a door with a smaller lick hole, and wherein, upon said fourth section of said adaptor meshes with said second recess of said guard collar, said second section of the adaptor is appropriate for a door with a larger lock hole.

4. The adjustable device for an auxiliary lock as recited in claim 2, wherein said fourth section of said adapter extending along with the radial direction form said second section outwardly.

5. The adjustable device for an auxiliary lock as recited in claim 3, wherein said first recess of said guard collar having a depth larger than the said second recess.

* * * * *